US007917056B2

(12) United States Patent
Burchette et al.

(10) Patent No.: US 7,917,056 B2
(45) Date of Patent: Mar. 29, 2011

(54) SYSTEMS AND METHODS FOR REMANUFACTURING IMAGING COMPONENTS

(75) Inventors: Lynton R. Burchette, Sanford, NC (US); William E. Thacker, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 12/205,407

(22) Filed: Sep. 5, 2008

(65) Prior Publication Data

US 2008/0317497 A1 Dec. 25, 2008

Related U.S. Application Data

(63) Continuation of application No. 11/254,136, filed on Oct. 19, 2005, now Pat. No. 7,424,245.

(51) Int. Cl.
*G03G 15/00* (2006.01)
*G03G 21/18* (2006.01)

(52) U.S. Cl. ..... 399/109; 399/111

(58) Field of Classification Search ..... 399/109, 399/107, 110, 111, 126; 347/49, 86, 138, 347/152; 361/748, 752
See application file for complete search history.

(56) References Cited

U.S. PATENT DOCUMENTS

| | | | | |
|---|---|---|---|---|
| 6,166,916 | A * | 12/2000 | Jelinger | 361/756 |
| 2002/0025186 | A1 * | 2/2002 | Karakama et al. | 399/111 |
| 2005/0036801 | A1 * | 2/2005 | Burchette | 399/109 |

* cited by examiner

*Primary Examiner* — Sophia S Chen

(57) ABSTRACT

Techniques for modifying an imaging cartridge includes providing the imaging cartridge including a body including a circuit holding structure sized to hold an electronic circuit and forming a modified circuit holding structure, with the modified circuit holding structure sized to hold a replacement electronic circuit. At least one dimension of the replacement electronic circuit may be greater than a corresponding dimension of the electronic circuit.

3 Claims, 9 Drawing Sheets

SYSTEMS AND METHODS FOR REMANUFACTURING IMAGING COMPONENTS

The present application is a continuation of allowed U.S. patent application Ser. No. 11/254,136 filed on Oct. 19, 2005 which is herein incorporated by reference in its entirety.

BACKGROUND

The present invention generally relates to manufacturing, remanufacturing or repairing replaceable imaging components, and more particularly to apparatus and techniques for modifying a replaceable imaging cartridge to operate with a replacement electronic circuit.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Some toner cartridges may include a chip having a memory device which is used to store data related to the cartridge or the imaging device, such as a printer, for example. The imaging device may communicate with the chip using a direct contact method or a broadcast technique utilizing radio frequency (RF) communication. This chip is typically mounted in a location, such as a slot, on the cartridge to allow for proper communication between the printer and the toner cartridge when the cartridge is installed in the printer. When the toner cartridge is being remanufactured, as described above, the chip provided by the original equipment manufacturer (OEM), such as Hewlett-Packard or Lexmark, may need to be replaced by a compatible chip developed by a third party. Such a replacement chip may be larger and not have the same physical form factor as the OEM chip and thus may not fit into the slot on the toner cartridge. Thus, it would be desirable to provide techniques for solving this problem and allowing a replacement chip having a different form factor be installed on the toner cartridge by, for example, modifying the toner cartridge to accept the replacement chip.

SUMMARY

In one aspect of the present invention a method of modifying an imaging cartridge includes providing the imaging cartridge comprising a body including a circuit holding structure sized to hold an electronic circuit and forming a modified circuit holding structure, with the modified circuit holding structure sized to hold a replacement electronic circuit. At least one dimension of the replacement electronic circuit may be greater than a corresponding dimension of the electronic circuit.

In another aspect of the present invention, a method of modifying an imaging cartridge includes providing the imaging cartridge comprising a body including a circuit holding structure sized to hold an electronic circuit, removing the circuit holding structure, and attaching a new circuit holding structure to the body of the imaging, with the new circuit holding structure sized to hold a replacement electronic circuit. At least one dimension of the replacement electronic circuit may be larger than a corresponding dimension of the electronic circuit.

In another aspect of the present invention, a method of modifying an imaging cartridge includes providing the imaging cartridge comprising a body including a circuit holding structure sized to hold an electronic circuit, disposing at least one conductive element in the circuit holding structure, attaching a replacement electronic circuit to the body of the imaging cartridge, with circuit holding structure not holding the replacement electronic circuit, and electrically connecting the replacement electronic circuit to the contact element.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge, such as an HP 2600 toner cartridge, are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
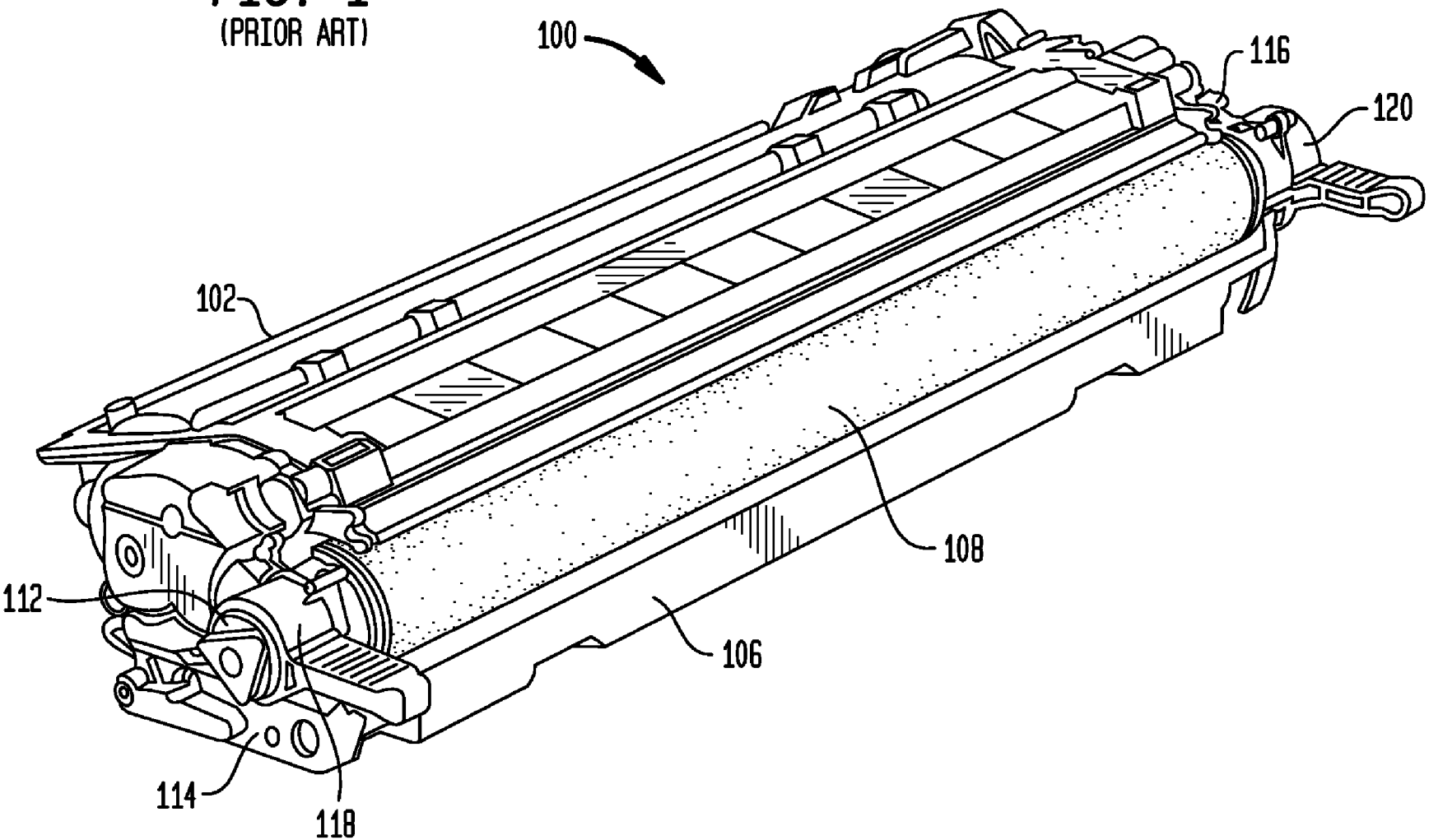
FIG. 1 (PRIOR ART)
FIG. 1 shows a perspective view of the drive side end of a prior art toner cartridge.
Figure 2:
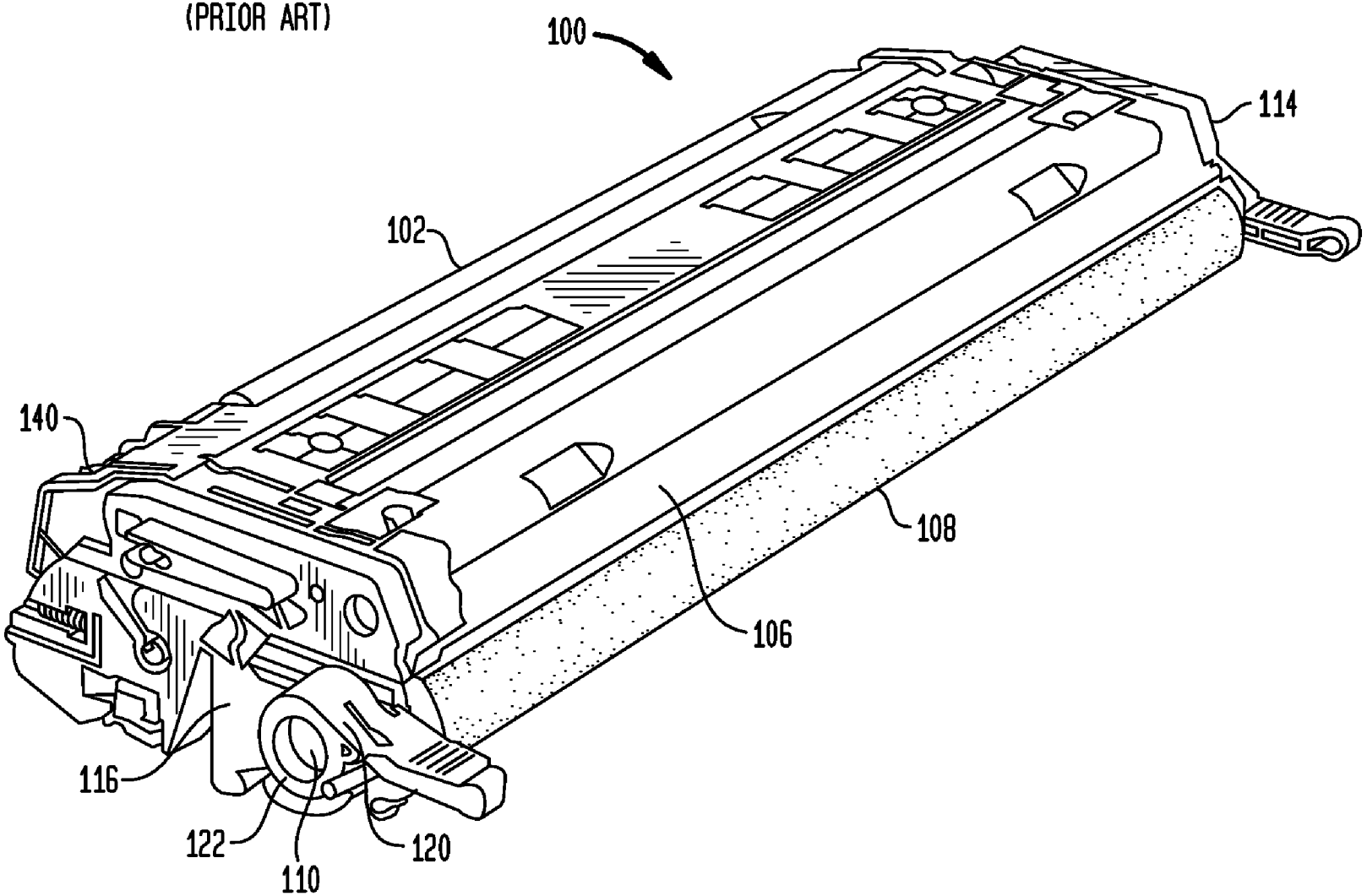
FIG. 2 (PRIOR ART)
FIG. 2 shows a perspective view of the non-drive side end view of a prior art toner cartridge.
Figure 3:
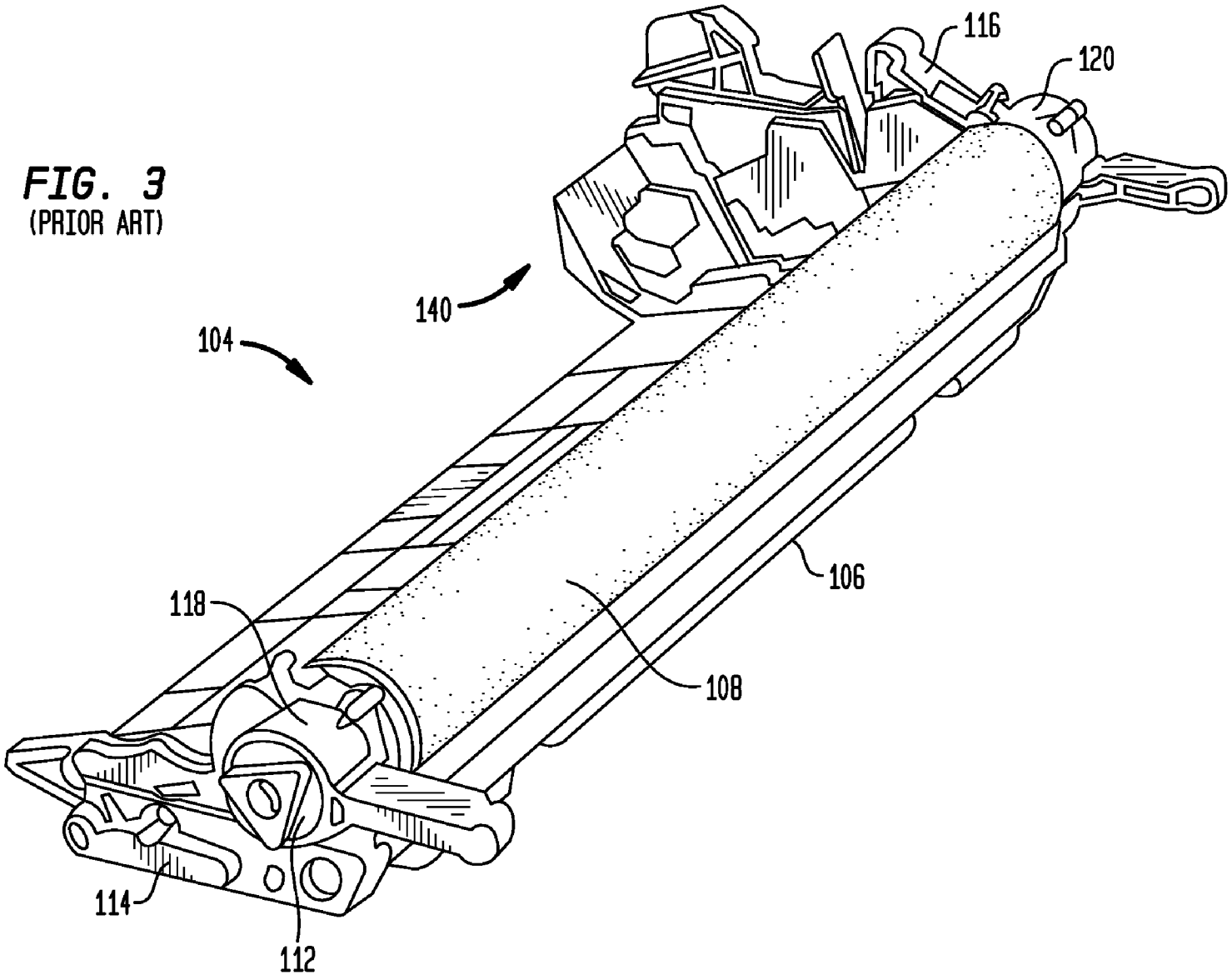
FIG. 3 (PRIOR ART)
FIGS. 3 and 4 show perspective views of a waste bin assembly.
Figure 4:
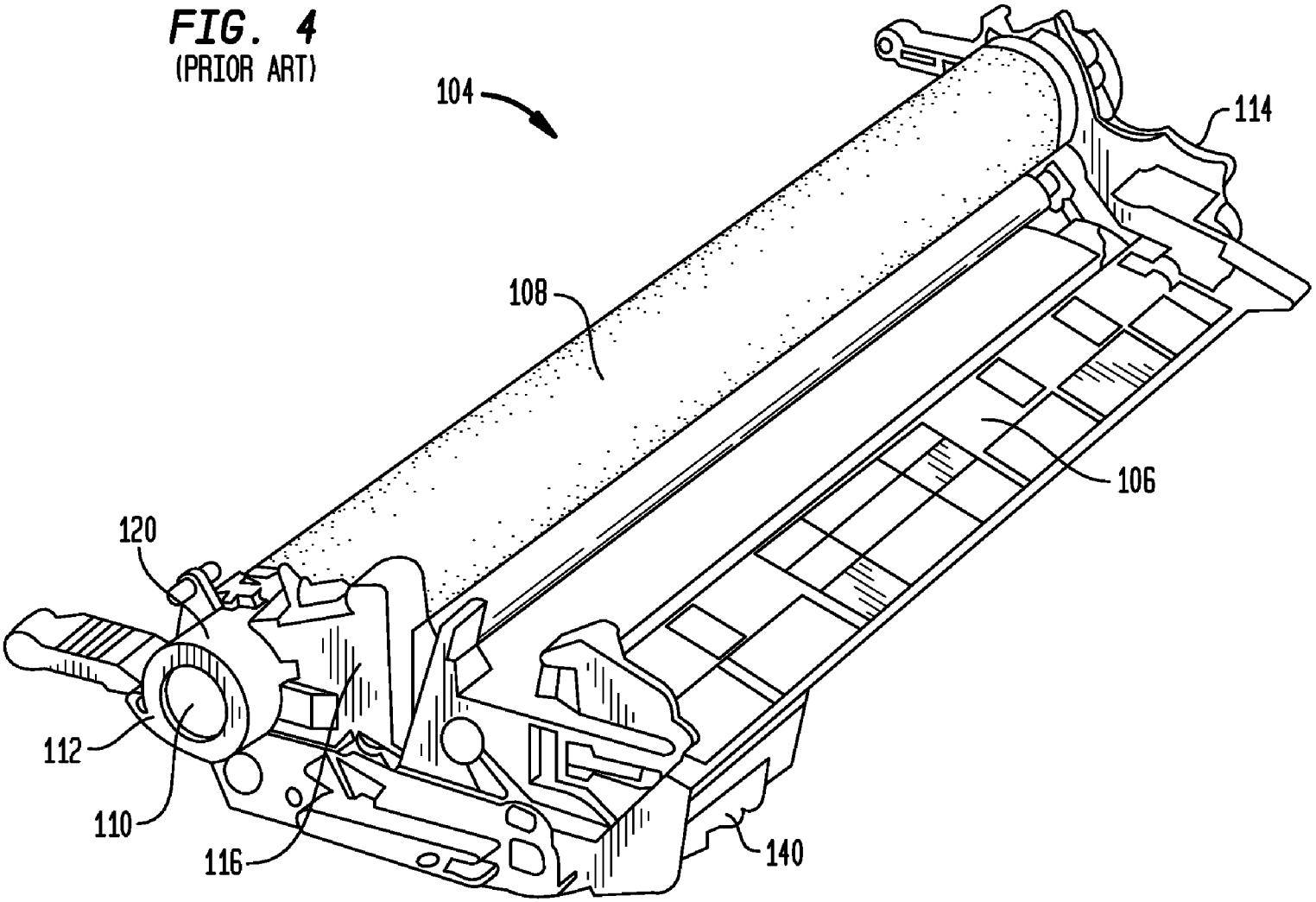
FIG. 4 (PRIOR ART)

FIGS. 1 and 2 show perspective views of a prior art toner cartridge 100. The toner cartridge 100 includes, among other components, a toner hopper assembly 102 and a waste bin assembly 104. FIGS. 3 and 4 show perspective views of the waste bin assembly 104 after separation from the toner cartridge 100. The waste bin assembly 104 includes a waste bin 106, an organic photo conductor (OPC) drum 108, and a chip holding structure 140, described in greater detail below. The OPC drum 108 comprises a cylindrical aluminum tube having first and second hubs 110 and 112, with each hub 110 and 112 extending from an end of the OPC drum 108. The OPC drum 108 is held in place by a drive side end cap 114 and a non-drive side end cap 116 which include OPC retaining members 118 and 120, respectively. The OPC retaining members 118 and 120 each include cylindrical openings which engage and hold the ends of the hubs 110 and 112 during the rotation of the OPC drum 108. The cylindrical opening of the OPC retaining member 120 is narrowed at the end by a flange 122.

Figure 5:
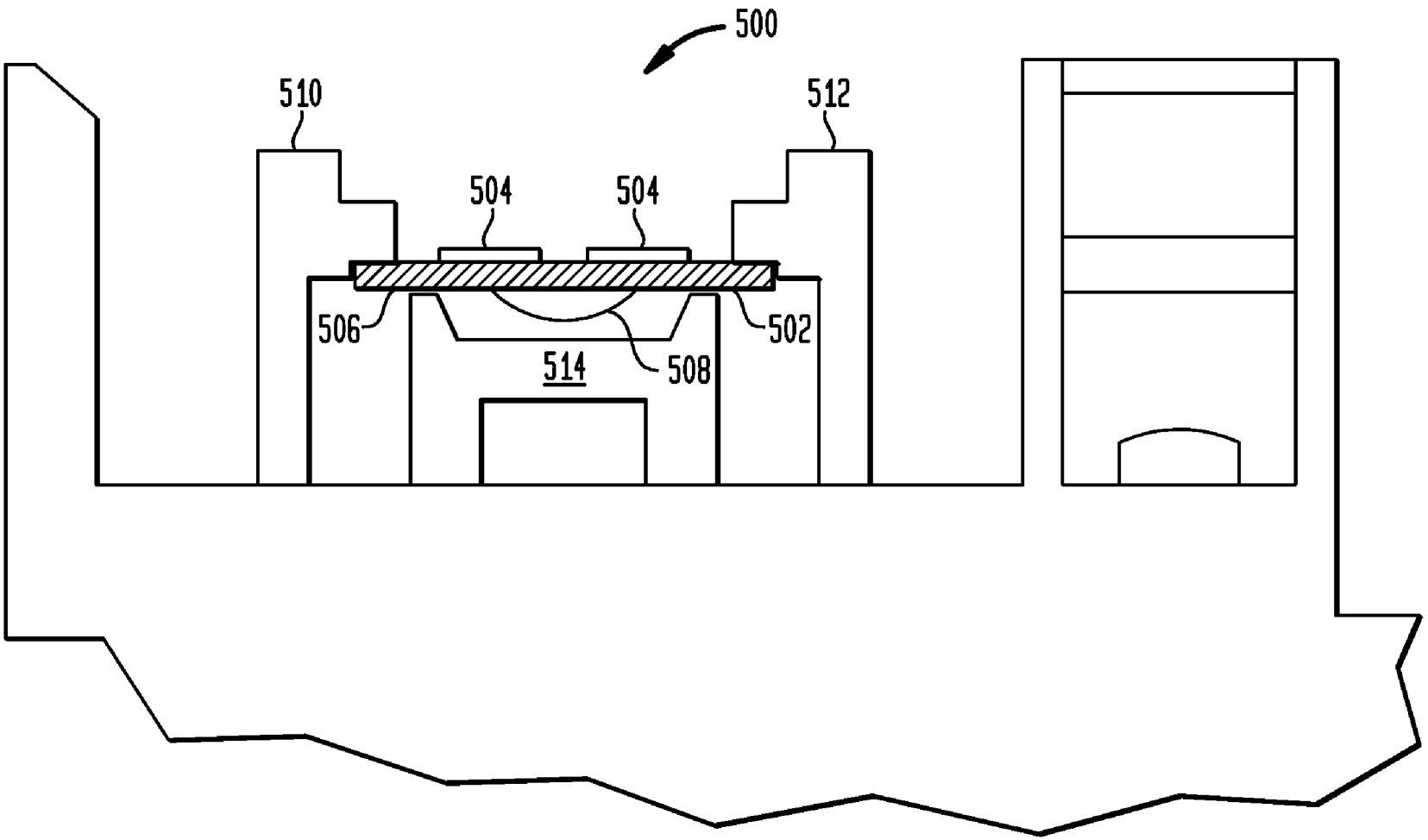
FIG. 5 (PRIOR ART)
FIG. 5 shows a cross-sectional view of a chip holding structure of a prior art toner cartridge.

FIG. 5 shows a cross-sectional view of a chip holding structure 500 of a prior art toner cartridge holding an OEM chip 502. The OEM chip 502 may include electrical contacts 504 on one side of a printed circuit board (PCB) 506 for engagement with the printer and circuitry 508 including a memory element on the opposing side. Plastic flanges 510 and 512 hold the OEM chip from the top and the sides while support member 514 supports the bottom of the chip 502. The support member 514 and the flanges 510 and 512 form a slot in which the chip 502 is inserted for attachment to the toner cartridge.

A replacement chip may be physically larger than the OEM chip 502 due to the inclusion of a microcontroller unit (MCU) or a system on a chip (SOC) and thus not fit into the slot housing the OEM chip. The present invention provides techniques for solving this problem and allowing a replacement chip having a different form factor be installed on the toner cartridge by, for example, modifying the toner cartridge to accept the replacement chip.

Figure 6:
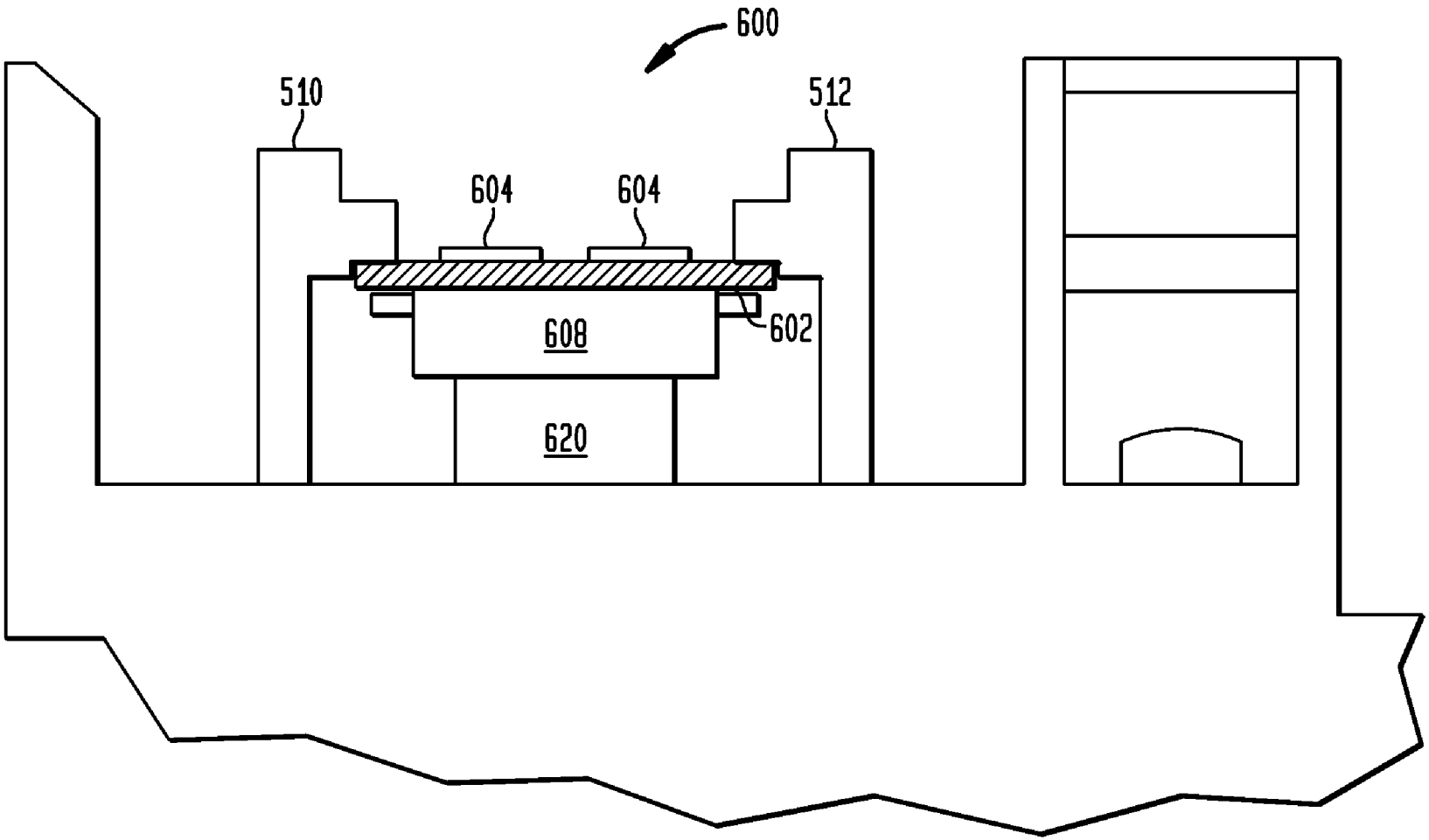
FIG. 6 shows a cross-sectional view of a modified chip holding structure in accordance with the present invention.
Figure 6A:
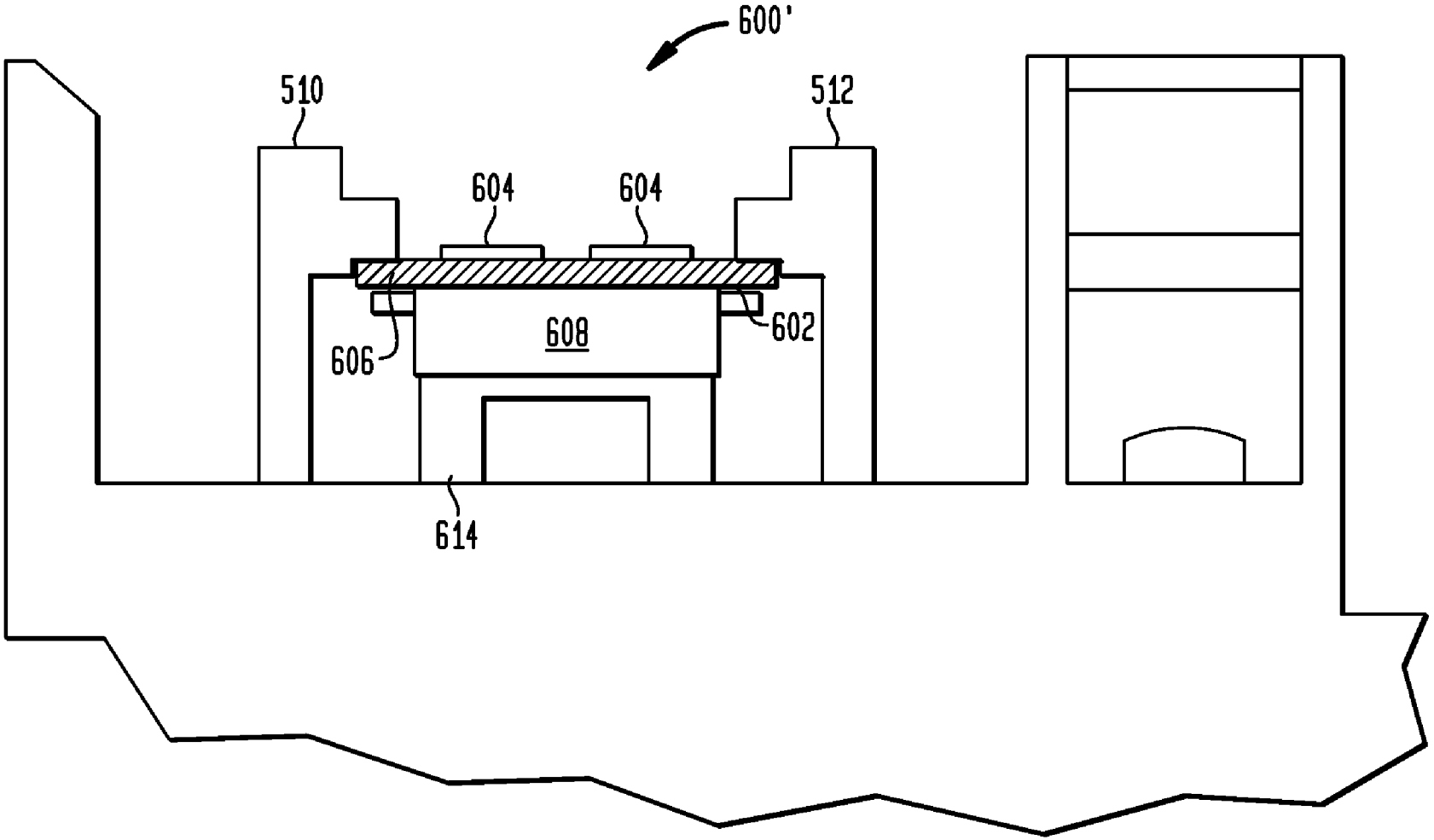
FIG. 6A shows a cross-sectional view of a modified chip holding structure in accordance with another aspect of the present invention

FIG. 6 shows a cross-sectional view of a modified chip holding structure 600 holding a replacement chip 602 in accordance with one aspect of the present invention. The replacement chip 602 may comprise contacts 604 on one side of a PCB 606 communicatively connected to a processing unit 608, such as a microcontroller, for example. Due to the size of the processing unit 608 or other components, the replacement chip 602 has a greater thickness than the chip 502 and will not fit in the chip holding structure 500. As shown in FIG. 6, the support member 514 (shown in FIG. 5) has been removed to allow the larger replacement chip 602 to be installed in the slot on the toner cartridge. The support member 514 may be removed by cutting, filing or some other suitable technique. The replacement chip 602 may be held in place by an adhesive which adheres the PCB 606 to the flanges 510 and 512, or some other suitable technique. Optionally, the replacement chip may be held in place by a replacement support member 620 (smaller than the support member 514) shaped to the appropriate size for supporting the larger replacement chip 602 and attached to the toner cartridge in the general area where support member 514 was removed. The support member 620 may comprise many suitable materials, including plastic and adhesive, for example. In another aspect of the present invention, as shown in the modified chip holding structure 600' of FIG. 6A, only a portion of the support member 514 is removed to form a supporting structure 614 sized to support the bottom of the replacement chip 602. Other techniques may also be utilized to hold the replacement chip in the slot of the modified toner cartridge.

Figure 7:
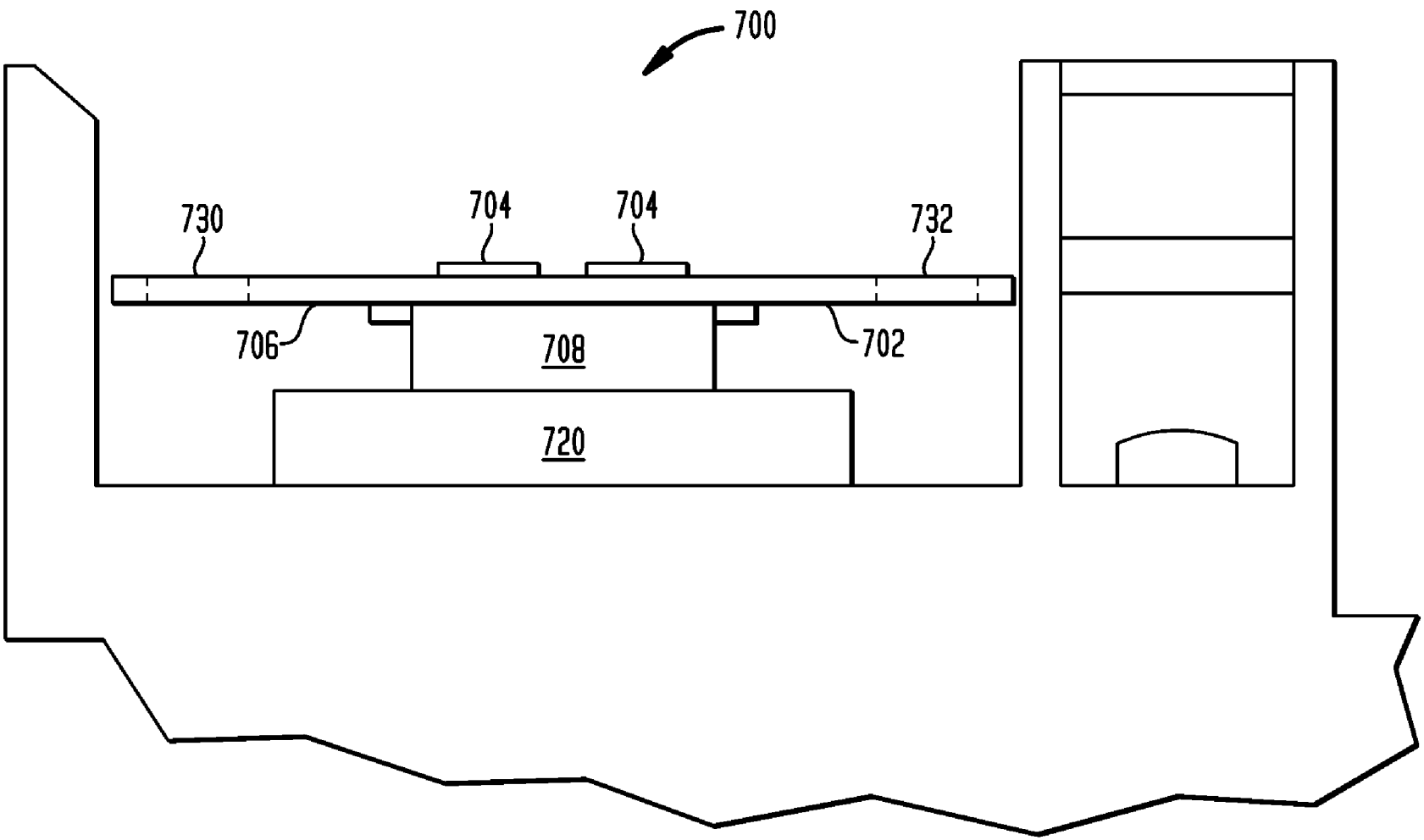
FIG. 7 shows a cross-sectional view of a new chip holding structure in accordance with the present invention.

FIG. 7 shows a cross-sectional view of a new chip holding structure 700 holding a replacement chip 702 in accordance with one aspect of the present invention. The replacement chip 702 may comprise contacts 704 on one side of a PCB 706 communicatively connected to a processing unit 708, such as a microcontroller, for example. Due to the size of the processing unit 708 or other components, the replacement chip 702 has a greater thickness and/or greater width than the chip 502 and will not fit in the chip holding structure 500. As shown in FIG. 7, the support member 514 and the flanges 510 and 512 have been removed to allow the larger replacement chip 702 to be installed in the toner cartridge. The support member 514 and the flanges 510 and 512 may be removed by cutting, filing or some other suitable technique. The replacement chip 702 may be held in place by one or more attachment members, such as member 720, shaped to the appropriate size for supporting the larger replacement chip 702 and attached to the toner cartridge, or some other suitable technique. The one or more attachment members 720 form the new chip holding structure 700. The member 720 may comprise many suitable materials, including plastic and adhesive, for example. The PCB 706 may include holes 730 and 732 for printer posts to pass through when the toner cartridge is installed in the printer. In another aspect of the present invention, only a portion of the support member 514 and the flanges 510 and 512 are removed to form a supporting structure sized to support the bottom of the replacement chip 702. Other techniques may also be utilized to hold the replacement chip in the slot of the modified toner cartridge. The processing circuitry 708 may be attached to either side of the PCB 706.

Figure 8:
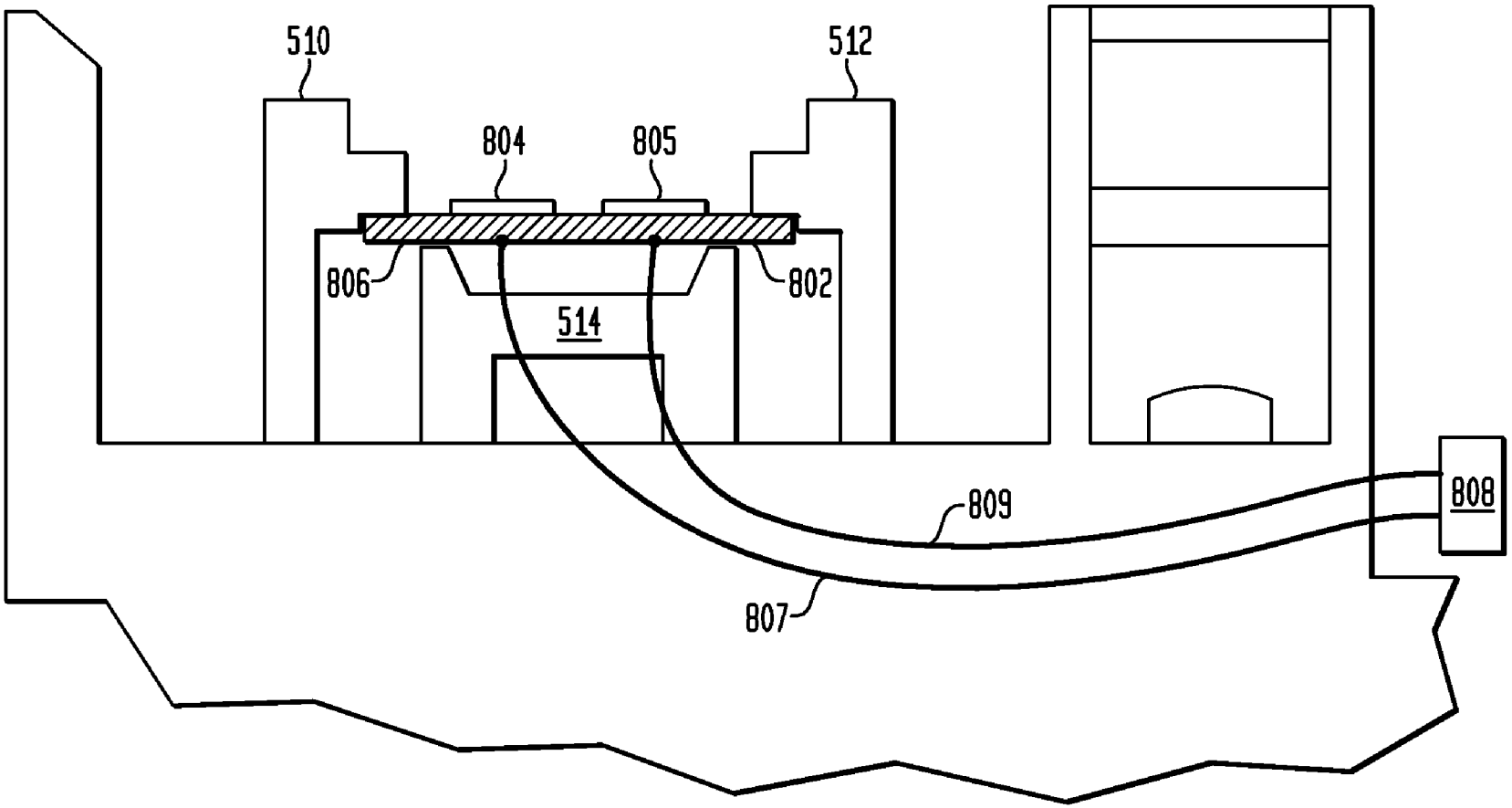
FIG. 8 shows a cross-sectional view of a chip holding structure holding a replacement contact element in accordance with the present invention.

In an alternate embodiment of the present invention, a replacement chip may be installed in the toner cartridge without making modifications to the chip holding structure 500. As shown in FIG. 8, a replacement contact element 802 may be installed in the chip holding structure 500. The replacement contact element 802 may comprise contacts 804 and 805 on one side of a PCB 806 communicatively connected to wires 807 and 809, respectively. This replacement contact element 802 preferably does not include a processing unit 808. The processing unit 808 may be attached to the toner cartridge in another location and connected to the contacts 804 and 805 through the wires 807 and 809. These wires 807 and 809 may be secured to the toner cartridge with tape or other appropriate means.

In another aspect of the present invention, either a portion of the waste bin assembly or the entire waste bin assembly may be replaced with a new waste bin assembly having the appropriate sized slot for the replacement chip. In one aspect of the present invention, the modifications to the toner cartridge may be accomplished with conventional cutting tools and a jig.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of modifying an imaging cartridge comprising:

providing the imaging cartridge comprising a body including a circuit holding structure sized to hold an electronic circuit;

replacing the electronic circuit with a replacement contact element, the replacement contact element not including a processing unit; and attaching a processing unit to the imaging cartridge, the processing unit communicatively connected to the replacement contact element.

2. The method of claim 1 wherein replacement contact element is attached to the imaging cartridge in a first location and the processing unit is attached to the imaging cartridge in a second location, the first location differing from the second location.

3. The method of claim 2 wherein the processing unit is communicatively connected to the replacement contact element by wires.

* * * * *